United States Patent [19]

Johnson

[11] Patent Number: 4,567,844

[45] Date of Patent: Feb. 4, 1986

[54] FISHING BOAT TEMPORARY TRAILER

[76] Inventor: Royce W. Johnson, 6604 S. E. 15, Midwest City, Okla. 73110

[21] Appl. No.: 621,983

[22] Filed: Jun. 18, 1984

[51] Int. Cl.[4] ..... B63B 21/64

[52] U.S. Cl. ..... 114/344; 280/414.5

[58] Field of Search ..... 280/414.5; 114/344

[56] References Cited

U.S. PATENT DOCUMENTS

| | | | |
|---|---|---|---|
| 2,578,376 | 12/1951 | Smith | 114/344 |
| 3,135,975 | 6/1964 | Andranigian | 114/344 |
| 3,337,229 | 8/1967 | Raymond | 114/344 |
| 3,831,211 | 8/1974 | Bustamante | 114/344 |
| 3,902,741 | 9/1975 | Rudder | 114/344 |
| 4,300,252 | 11/1981 | Montooth . | |
| 4,480,578 | 11/1984 | Fisher et al. | 114/344 |

*Primary Examiner*—Trygve M. Blix
*Assistant Examiner*—Thomas J. Brahan
*Attorney, Agent, or Firm*—Robert K. Rhea

[57] ABSTRACT

In a fishing boat short haul supporting device a pair of wheels are journalled by horizontal axles strut connected with the boat transom by pivotally connected plates to support the boat stern. A trailer hitch equipped tongue secured to the boat stem and braced with the gunwales by rod stabilizers, support the bow when connected with a self propelled vehicle.

2 Claims, 5 Drawing Figures

FISHING BOAT TEMPORARY TRAILER

BACKGROUND OF THE INVENTION

1. Field of the Invention

The present invention relates to fishing boats and more particularly to a temporary wheel support and trailer hitch tongue for short haul moving the boat.

Some fishermen, as for example, when vacationing in a travel trailer, carry a lightweight fishing boat on the top of the towing vehicle and may trail a smaller self propelled vehicle behind the travel trailer. The travel trailer is usually parked, as in a trailer park, some distance from one or more bodies of water to be fished. It is, therefore, desirable to provide some means of easily transporting the fishing boat to and from the areas being fished.

This invention provides such a short haul fishing boat trailer-type device.

2. Description of the Prior Art

U.S. Pat. No. 4,300,252 discloses a stern and bow supporting wheel mechanism for launching a boat as from a boat ramp, or the like, in which the stern supporting wheels are attached to the transom and may be pivoted to an upward out of the water position. The bow supporting wheel includes a framework connected to the forward end portion of the boat in which the wheel thereof is provided with a brake mechanism to prevent unauthorized movement of the boat down a launching ramp and into the water.

This invention provides wheel supporting brackets for connection with lateral end portions of a boat transom permitting removal of the wheels from the boat as well as upward out of the water positioning of the wheels. A trailer hitch equipped tongue is removably connected to the bow by a trailer hitch bracket secured to the stem.

SUMMARY OF THE INVENTION

Right and left wheel equipped boat stern supporting apparatus are mirror images of each other. Each wheel apparatus comprises an elongated apertured plate for bolted connection with the laterally upward end portion of the boat stern so that one end of each plate projects laterally of the boat. An interdigitated hinge, having cooperating parts on the elongated plate and one end of a strut plate having struts straddling and journalling a wheel, connects the wheel to the elongated plate by a hinge pin for upward pivoting movement of the wheel about the axis of the hinge. A spring urged latch pin, mounted on the strut plate, releaseably engages an aperture in a keeper for normally maintaining the wheel in boat supported position. A trailer hitch equipped tongue is removably connected with a boat stem connected trailer tongue bracket. A pair of stabilizers connect the forward end portion of both gunwales to the trailer tongue intermediate its ends.

The principal object of this invention is to provide a three part wheel and trailer hitch mechanism for transporting a fishing boat in trailer fashion for short haul distances which remains attached to the boat during over-the-road travel and in which the mechanism may remain attached to the boat, with the wheels pivoted to an out of the water position, while the boat is water borne.

DESCRIPTION OF THE PREFERRED EMBODIMENT

Figure 1:
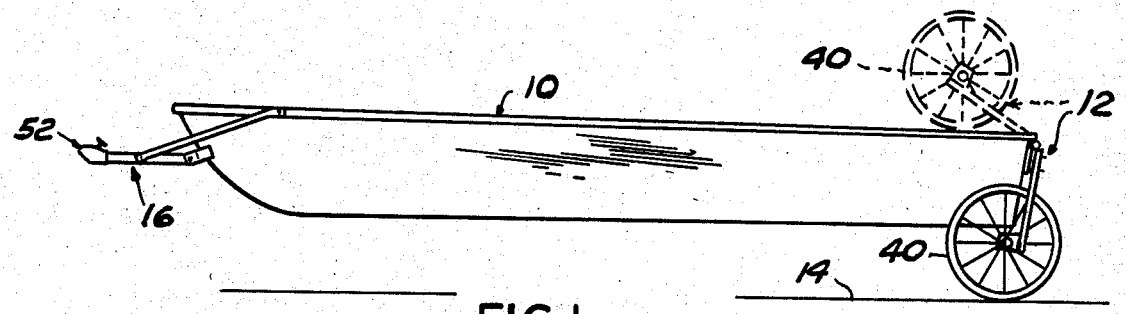
FIG. 1 is a side elevational view of a fishing boat having the apparatus installed thereon and illustrating, by dotted lines, upward out of the water movement of one of the wheels.
Figure 2:
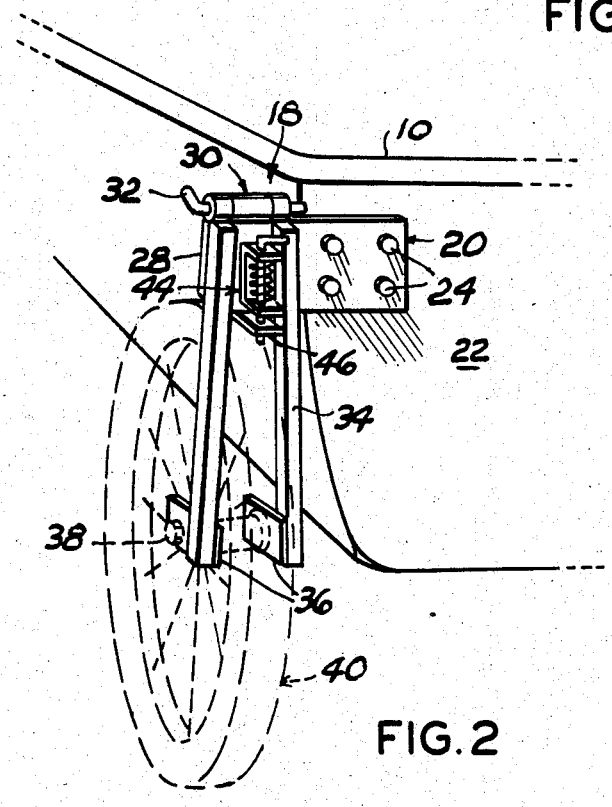
FIG. 2 is a fragmentary perspective view, to a larger scale, illustrating one of the wheel apparatus in boat supporting position, the wheel being shown by dotted lines for clarity.
Figure 3:
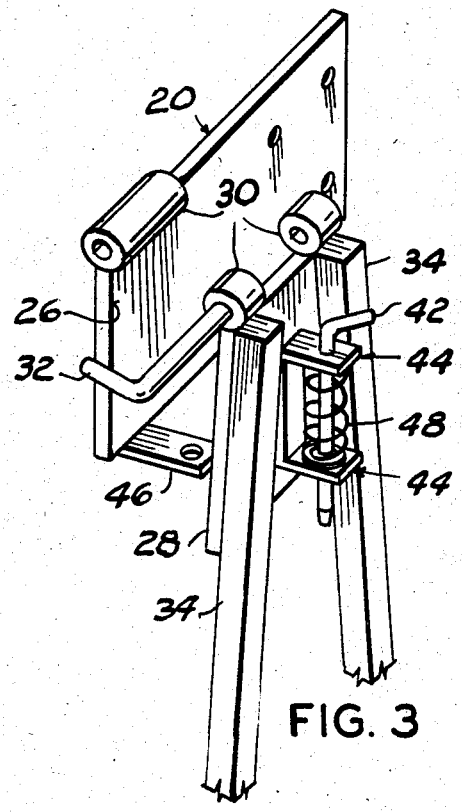
FIG. 3 is a fragmentary exploded perspective view, to another scale.

Like characters of reference designate like parts in those figures of the drawings in which they occur.

In the drawings:

The reference numeral 10 indicates a conventional light-weight boat commonly referred to as a "fishing boat" usually moved, when in the water, by oars or an outboard motor, neither of which are shown.

The reference numeral 12 indicates one of a pair of wheel apparatus respectively secured to lateral end portions of the boat transom for normally supporting the boat above the surface of the earth 14. A trailer hitch tongue apparatus 16 is secured to the bow for short haul movement of the boat 10 in trailer fashion by a self propelled vehicle, not shown. Each of the pair of wheel apparatus 12 is a mirror image of the other and only the left wheel apparatus 18 is illustrated and described, in the interest of brevity.

The apparatus 18 comprises an elongated plate 20 which is flatly secured, at one end portion, to the boat transom 22 near its lateral upper limit by a plurality of bolts 24, or the like. The other end portion 26 of the elongated plate 20 projects laterally, a selected distance, beyond the adjacent side of the boat. A strut plate 28, having a vertical dimension slightly less than the width or vertical dimension of the elongated plate 20, normally flatly contacts the end portion 26 of the elongated plate. Interdigitated hinge members are cooperatively secured to the upper edge surface of the plates 20 and 28 to form a hinge 30 having a horizontal removable hinge pin 32 for the purposes presently explained.

A pair of wheel struts 34 are secured by their upper end portions to the strut plate, on its surface opposite the elongated plate 20, in downwardly diverging relation. At their depending ends, the wheel struts are each provided with horizontally line apertured forwardly projecting parallel hub plates 36 which cooperatively receive and journal the axle 38 of a wheel 40.

A latch pin 42, projecting vertically through the legs of a U-shaped bracket 44, having its bight portion secured to the rearward surface of the strut plate 28 between the struts 34, normally engages the aperture in a keeper 46 horizontally secured to the depending surface of the elongated plate end portion 26 and projecting rearwardly under the strut plate 28. A spring 48, interposed between the legs of the latch bracket 44, secures the latch pin 42 in wheel downward locked position.

Figure 4:
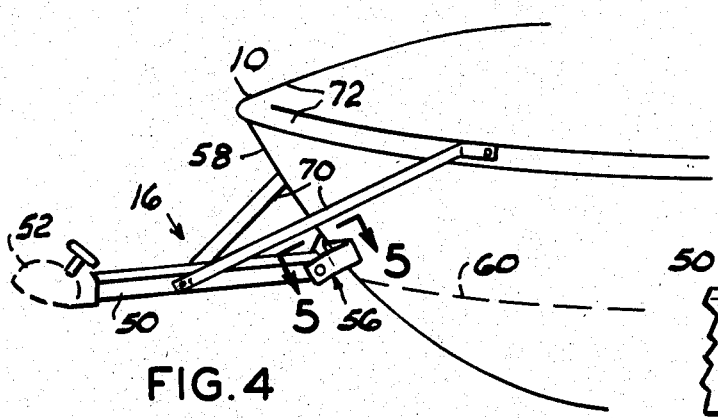
FIG. 4 is a fragmentary perspective view, to a different scale, of the trailer hitch components; and, FIG. 5 is a horizontal sectional and plan view, to a different scale, taken substantially along the line 5—5 of FIG. 4.
Figure 5:
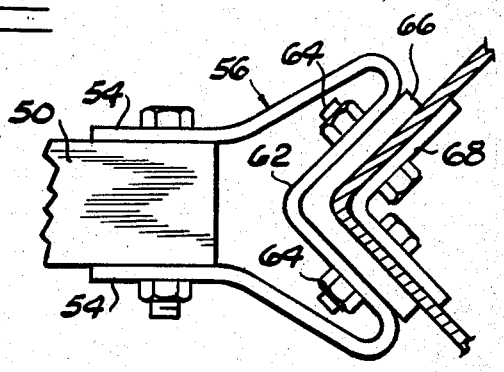

Referring now more particularly to FIGS. 4 and 5, the tongue means 16 includes an elongated channel-like tongue 50 having a trailer ball receiving hitch 52 secured to one end thereof. The other end of the trailer tongue 50 is interposed and bolt secured between the legs 54 of a generally U-shaped stem bracket 56 secured to the boat stem 58 preferably above the water line indicated by the dashed line 60. The bracket legs 54 are parallel at their tongue connected free end portions and diverge intermediate their ends toward opposing sides of the bow with the bight portion 62 of the bracket forming a substantially V-shape cooperating with the boat surface adjacent the stem for contiguously contacting the adjacent boat surfaces. The bight portion 62 is apertured for receiving bolts 64 securing the bracket to the stem. A resilient spacer 66 is preferably interposed between the bracket bight portion 62 and the boat and a strap metal or angle iron stiffener 68 is gripped by the heads of the attaching bolts 64.

A pair of rod-like stabilizers 70 are connected at one end to respective opposing sides of the tongue 50 and are removably connected, respectively, at their other ends to the forward end portion of the boat gunwales 72. The purpose of the stabilizers 70, in addition to stabilizing the bow against lateral movement of the boat, is to act as braces and provide lift for elevating the bow when the trailer hitch 52 is gripping a hitch ball, not shown, so that the bow is maintained in spaced relation above the surface of the earth 14 for movement of the boat.

Operation

In operation, the pair of wheels 12 and the tongue assembly 16 are secured to the boat, as described hereinabove, and normally remains in the solid line position of FIG. 1. When the boat 10 is unloaded and supported by the earth 14, the hitch assembly 16 is connected with a towing vehicle for movement to a desired location where the boat, after being disconnected from the towing vehicle, is manually placed in the water, not shown. The pair of wheels 12 are preferably elevated to the dotted line position of FIG. 1 accomplished by momentarily lifting the latch pin 42 so that the wheel and its struts may be manually pivoted rearwardly and upwardly about the axis of the hinge 30. In its upward position the wheel is disposed forwardly with respect to a vertical plane through the axis of the hinge pin 32, so that gravity maintains the wheels in the upward position. Obviously, the wheels may be disconnected from the boat by removing the hinge pins 32. Similarly, the hitch assembly 16 may be removed from the bow by unbolting the stabilizers 70 at the gunwales 72 and the tongue 50 at the stem bracket.

Obviously the invention is susceptible to changes or alterations without defeating its practicability. Therefore, I do not wish to be confined to the preferred embodiment shown in the drawings and described herein.

I claim:

1. A trailer-type support for short haul movement of a fishing boat, comprising:

an elongated plate flatly connected horizontally by one end portion with the respective lateral upper limit of the boat transom and projecting at its other end portion beyond the lateral limit of the transom;

a strut plate;

wheel means including a pair of struts connected at one end portion with said strut plate and journalling a wheel on a horizontal axis at their other end portion;

hinge means connecting said strut plate to the laterally outward end portion of said elongated plate for vertical pivoting movement of the wheel means about a horizontal axis in a vertical plane spaced laterally of the boat from a first downward position normally supporting the stern of the boat above the surface of the earth to a second elevated position above the upper limit of the boat and tilted toward the boat bow beyond a transverse vertical plane through the hinge means axis;

latch means connecting said strut plate to said elongated plate for normally maintaining said wheel means in a boat stern supporting position; and, tongue means including a tongue having a trailer hitch at one end and secured at it other end to the stem of said boat for connection with a self propelled vehicle and supporting the bow above the surface of the earth.

2. The boat support according to claim 1 in which said tongue means further includes:

a pair of rod-like stabilizers extending between and secured at their respective ends with opposing sides of the tongue and the gunwale at respective sides of the bow.

* * * * *